US007355133B2

(12) United States Patent
McCoy

(10) Patent No.: US 7,355,133 B2
(45) Date of Patent: Apr. 8, 2008

(54) SYSTEM, DEVICE, AND METHOD FOR SECURING A CIRCUIT BREAKER ACTUATOR

(75) Inventor: Brian Timothy McCoy, Norcross, GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 362 days.

(21) Appl. No.: 10/716,715

(22) Filed: Nov. 19, 2003

(65) Prior Publication Data

US 2004/0099514 A1 May 27, 2004

Related U.S. Application Data

(60) Provisional application No. 60/428,532, filed on Nov. 22, 2002.

(51) Int. Cl.
*H01H 9/20* (2006.01)

(52) U.S. Cl. ..... 200/50.11; 200/332.2

(58) Field of Classification Search ..... 200/330–335, 200/400, 401
See application file for complete search history.

(56) References Cited

U.S. PATENT DOCUMENTS 3,697,714 A * 10/1972 Gryctoko et al. ..... 200/330
4,211,906 A * 7/1980 Habedank et al. ..... 200/330
4,513,183 A 4/1985 Hill
4,628,160 A 12/1986 Canevari
4,872,099 A * 10/1989 Kelley et al. ..... 362/295
4,978,816 A * 12/1990 Castonguay et al. ..... 200/43.14
5,136,127 A 8/1992 Blair
5,148,910 A * 9/1992 Williams ..... 200/43.19
5,209,343 A 5/1993 Romano et al.
5,219,070 A * 6/1993 Grunert et al. ..... 200/330
5,422,453 A * 6/1995 Smith et al. ..... 200/329
5,500,495 A * 3/1996 Benda et al. ..... 200/43.14
5,577,599 A * 11/1996 Turek et al. ..... 200/43.14
5,905,239 A * 5/1999 Turner et al. ..... 200/330
6,137,068 A * 10/2000 Padulo ..... 200/43.16
6,373,004 B1 * 4/2002 Jackson ..... 200/50.1
6,396,008 B1 * 5/2002 Maloney et al. ..... 200/43.14
7,019,240 B2 * 3/2006 Eberts et al. ..... 200/331

* cited by examiner

*Primary Examiner*—Elvin Enad
*Assistant Examiner*—Lisa Klaus

(57) ABSTRACT

Certain exemplary embodiments provide a securement adapted to interface with a circuit breaker. A circuit breaker can comprise an actuator operable within an actuator operation zone defined by movement of the actuator between a first pole and a second pole. The securement can comprise an actuator restrainer and/or a substantially planar actuator guard coupled to said actuator restrainer. The securement can be operable between a first position and a second position. In the first position, the actuator can be manually operated between the first and second pole. In the second position, the substantially planar actuator guard can be located outside the actuator operation zone and/or substantially prevent manual access to the actuator.

24 Claims, 10 Drawing Sheets

SYSTEM, DEVICE, AND METHOD FOR SECURING A CIRCUIT BREAKER ACTUATOR

CROSS-REFERENCE TO RELATED APPLICATIONS

This application claims priority to, and incorporates by reference in its entirety, pending U.S. Provisional Patent Application Ser. No. 60/428,532, filed 22 Nov. 2002.

BRIEF DESCRIPTION OF THE DRAWINGS

A wide array of potential embodiments can be better understood through the following detailed description and the accompanying drawings in which.

and

Figure 10:
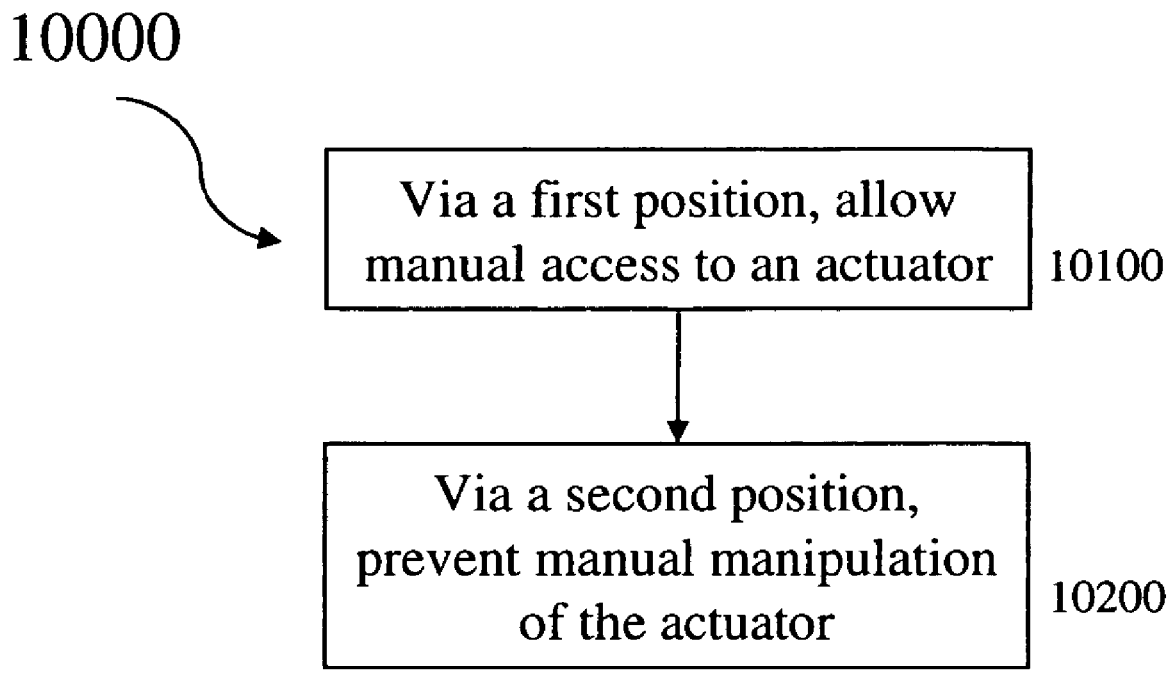

FIG. 10 is a flow chart of an exemplary embodiment of a method 10000.

DEFINITIONS

When the following terms are used herein, the accompanying definitions apply:

switch (or switching device)—any device that comprises a lever or actuator, the manual manipulation of which substantially prevents or allows current flow through a circuit to which the device is electrically coupled. An exemplary embodiment of a switch can be a standard light switch that when positioned at a first pole, corresponding to an ON position, can allow power to flow through a circuit, and when positioned at a second pole, corresponding to an OFF position, can interrupt power to the circuit. Another exemplary embodiment of a switch is a circuit breaker. A switch can be manually operated by an actuator, such as a lever.

actuator—any device that can activate an apparatus to which it is coupled. An exemplary embodiment of an actuator is a lever coupled to an electrical switch, such as a lever on a light switch and/or circuit breaker. Movement of an actuator from a first pole to a second pole can define an actuator operation zone.

circuit breaker—any device designed to open and close a circuit by non automatic means and to open the circuit automatically on a predetermined overcurrent. A circuit breaker can be of any type that comprises one or more switches, such as an arc-fault circuit interrupter (AFCI), a ground-fault circuit interrupter (GFCI), thermal magnetic, and/or any equivalents thereof, etc. A circuit breaker switch can have a first pole corresponding to an ON position (where current can flow) and a second pole corresponding to an OFF position (where current can not flow). A circuit breaker can comprise one or more actuators. A circuit breaker can have an automatic tripping function wherein an actuator does not necessarily move completely to the OFF position when the corresponding circuit is interrupted.

automatic tripping mechanism—any attribute of a circuit breaker whereby the circuit breaker trips (interrupts the circuit) even if an actuator of the switch is prevented from moving to the OFF position. A circuit breaker that comprises an automatic tripping mechanism can be reset and/or its actuator held ON even with an overload or excessive heat present in the circuit. The mechanism by which the tripping function is activated can be of any type, including magnetic, thermal overcurrent, thermal magnetic, magnetic-hydraulic, electronic, and/or any equivalents thereof, etc.

unitary actuator—any single actuator that corresponds to a single switch. Certain exemplary embodiments of a unitary actuator can be linked to a single automatic tripping and/or manual switching mechanism that functions independently of other actuators in the circuit breaker.

bridged actuators—any plurality of actuators joined together to enable joint manual manipulation and/or automatic tripping. Certain exemplary embodiments of a single circuit breaker can comprise unitary and/or bridged actuators, such as a four-actuator circuit breaker with the two outer actuators being unitary and the two inner actuators configured as a bridged unit. Certain exemplary embodiments of bridged actuators can be irreversibly joined when the circuit breaker is manufactured. Alternatively, bridged actuators can be configured when a bridge is attached between two or more unitary actuators. A bridge refers to any means to connect two or more actuators.

DETAILED DESCRIPTION

Certain exemplary embodiments provide a securement adapted to interface with a circuit breaker. A circuit breaker can comprise an actuator operable within an actuator operation zone defined by movement of the actuator between a first pole and a second pole. The securement can comprise an actuator restrainer and/or a substantially planar actuator guard coupled to the actuator restrainer. In certain operative embodiments, the securement can be operable between a first position and a second position. In the first position, the actuator can be manually operated between the first and second pole. In the second position, the substantially planar actuator guard can be located outside the actuator operation zone and/or substantially prevent manual access to the actuator. In the second position, the actuator restrainer can be positioned substantially within the actuator operation zone and/or upon direct contact of the actuator with the actuator restrainer, the actuator strainer can substantially resist manual manipulation of the actuator from the first pole to the second pole.

Figure 1:
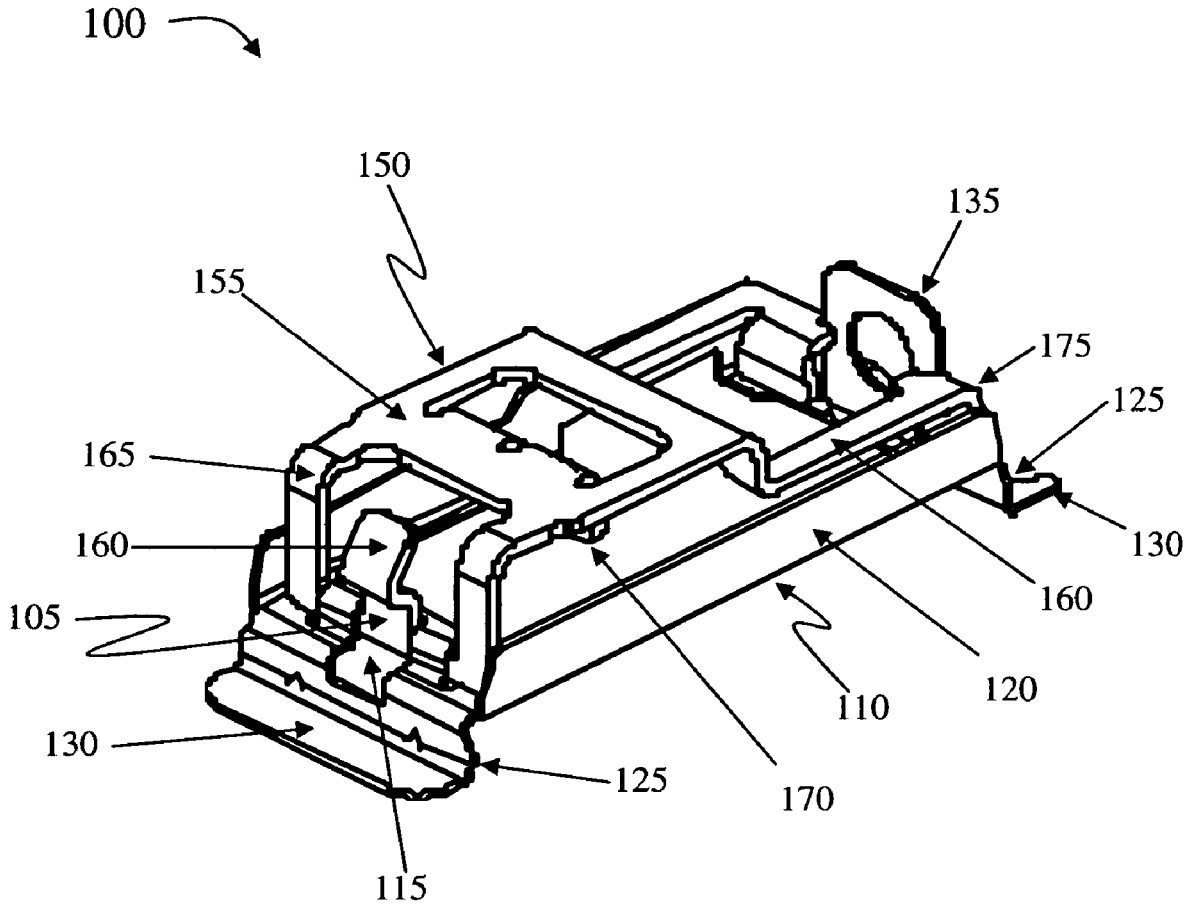
FIG. 1 is a perspective view of an exemplary embodiment of a securement in a closed position.

FIG. 1 is a perspective view of an exemplary embodiment of a securement 100 in a closed position. Certain exemplary embodiments of securement 100 can be adapted to fit and/or interact with a circuit breaker comprising at least one actuator. Securement 100 can comprise a base component 110 and an actuator guard 150. Actuator guard 150 can be substantially planar and, in relation to base component 110, can comprise a first planar portion 155 and a second planar portion 160. Base component 110 and actuator guard 150 can be attached via a hinge joint 105. Certain exemplary embodiments of hinge joint 105 can be formed via placement of a hinge pivot shaft 180, a subcomponent of actuator guard 150, through a hinge receptor 115, a subcomponent of base component 110. In alternative exemplary embodiments of securement 100, actuator guard 150 can comprise hinge receptor 115 and/or base component 110 can comprise hinge pivot shaft 180. Hinge joint 105 can be disassembled, and actuator guard 150 detached from base component 110, via removal of hinge pivot shaft 180 from hinge receptor 115. Certain exemplary embodiments of hinge joint 105 can be formed at manufacture and thus be incapable of disassembly. Hinge joint 105 can comprise any mechanical means that can enable actuator guard 150 to rotate away from base component 110 to an open position whereby one can manually move an actuator of a circuit breaker with which securement 100 is associated.

Certain exemplary embodiments of actuator guard 150 can substantially conform to the perimeter of base component 110. Base component 110 can be of any shape. Certain exemplary embodiments of base component 110 can be substantially rectangular, with substantially parallel raised edges 120 defining a length of base component 110 and substantially parallel depressed edges 125 defining a width of base component 110. Depressed edges 125 can comprise a lip 130 that extends away from base component 110 and substantially parallel to actuator guard 150. Base component 10 can comprise a lock receptor 135. Lock receptor 135 can be of any shape and can be adapted to interact with any type of lock, such as a keyed lock, combination lock, padlock, scissors lock, lock cable, and/or any equivalents thereof, etc. When lock receptor 135 interacts with a locking device, securement 100 can be substantially secured in a closed position.

Certain exemplary embodiments of actuator guard 150 can be coupled to and/or formed integral with one or more actuator restrainers 170. Any angle can be formed at the junction of actuator restrainer 170 and actuator guard 150. In certain exemplary embodiments, actuator restrainer 170 can be oriented substantially perpendicular to the first planar portion 155 of actuator guard 150. Actuator restrainer 170 can be permanently integrated with actuator guard 150. In certain exemplary embodiments of actuator guard 150, actuator restrainer 170 can be removably coupled to actuator guard 150. In an exemplary embodiment, actuator restrainer 170 and actuator guard 150 can be joined by a means wherein the orientation of actuator restrainer 170 in relation to first plane 155 can be manually adjusted, for example from a substantially perpendicular orientation to a substantially parallel orientation with respect to first planar portion 155.

Certain exemplary embodiments of actuator guard 150 can comprise first descending edges 165 and second descending edges 175. First descending edges 165 can comprise hinge pivot shaft 160. Second descending edges 175 can be adapted to interact with lock receptor 135 of base component 110. Dimensions of first descending edges 165 and/or second descending edges 175 can be chosen to position first planar portion outside of an operating zone of an actuator of a circuit breaker with which securement 100 is associated.

Figure 2:
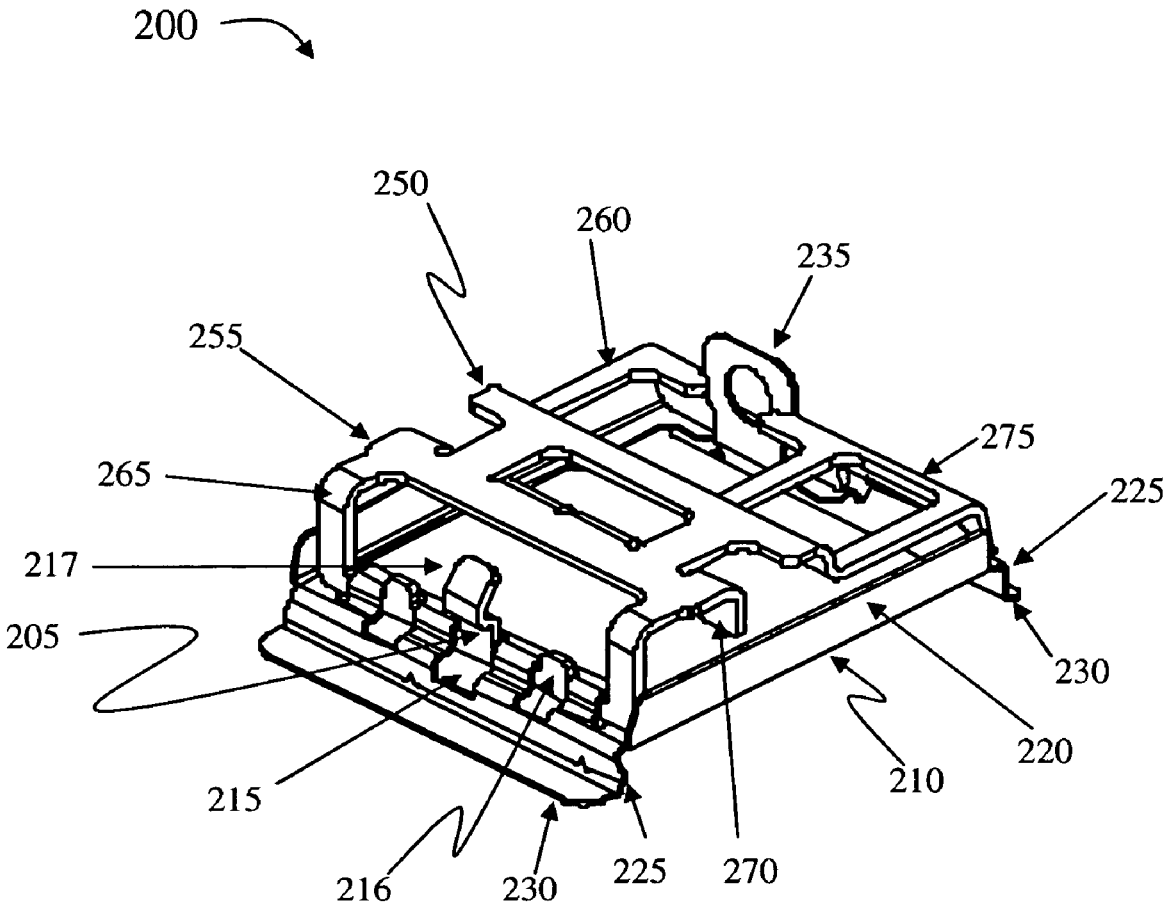
FIG. 2 is a perspective view of an exemplary embodiment of a securement in a closed position.

FIG. 2 is a perspective view of an exemplary embodiment of a securement 200 in a closed position. Certain exemplary embodiments of securement 200 can be adapted to fit and/or interact with a circuit breaker comprising a plurality of actuators. Securement 200 can comprise a base component 210 that can be adapted to fit and/or attach to a face of a circuit breaker comprising any number of actuators. The actuators can be bridged and/or unitary. Certain exemplary embodiments of base component 210 can comprise substantially parallel raised edges 220 and/or substantially parallel depressed edges 225 that can further comprise a lip 230. Base component 210 can also comprise a lock receptor 235.

Certain exemplary embodiments securement 200 can also comprise an actuator guard 250. Certain exemplary embodiments of actuator guard 250 can be adapted to fit base component 210. Actuator guard 250 can be coupled to one or more actuator restrainers 270. Certain exemplary embodiments of actuator guard 250 can be substantially planar. Actuator guard 250 can comprise a first planar portion 255 and/or a second planar portion 260. Certain exemplary embodiments of actuator restrainer 270 can be formed and/or coupled in a substantially perpendicular orientation with respect to first planar portion 255. Actuator guard 250 can comprise a first descending edges 265 and/or second descending edges 275.

Certain exemplary embodiments of securement 200 can comprise only actuator guard 250. Other exemplary embodiments of securement 200 can comprise actuator guard 250 joined to base component 210 via a hinge joint 205. Hinge joint 205 can comprise a hinge pivot shaft 217 inserted through hinge receptor 215. Securement 200 can comprise one or more auxiliary hinge joints 216, particularly when securement 200 is adapted to fit, interact with, and/or interface with a circuit breaker comprising a plurality of actuators.

Figure 3:
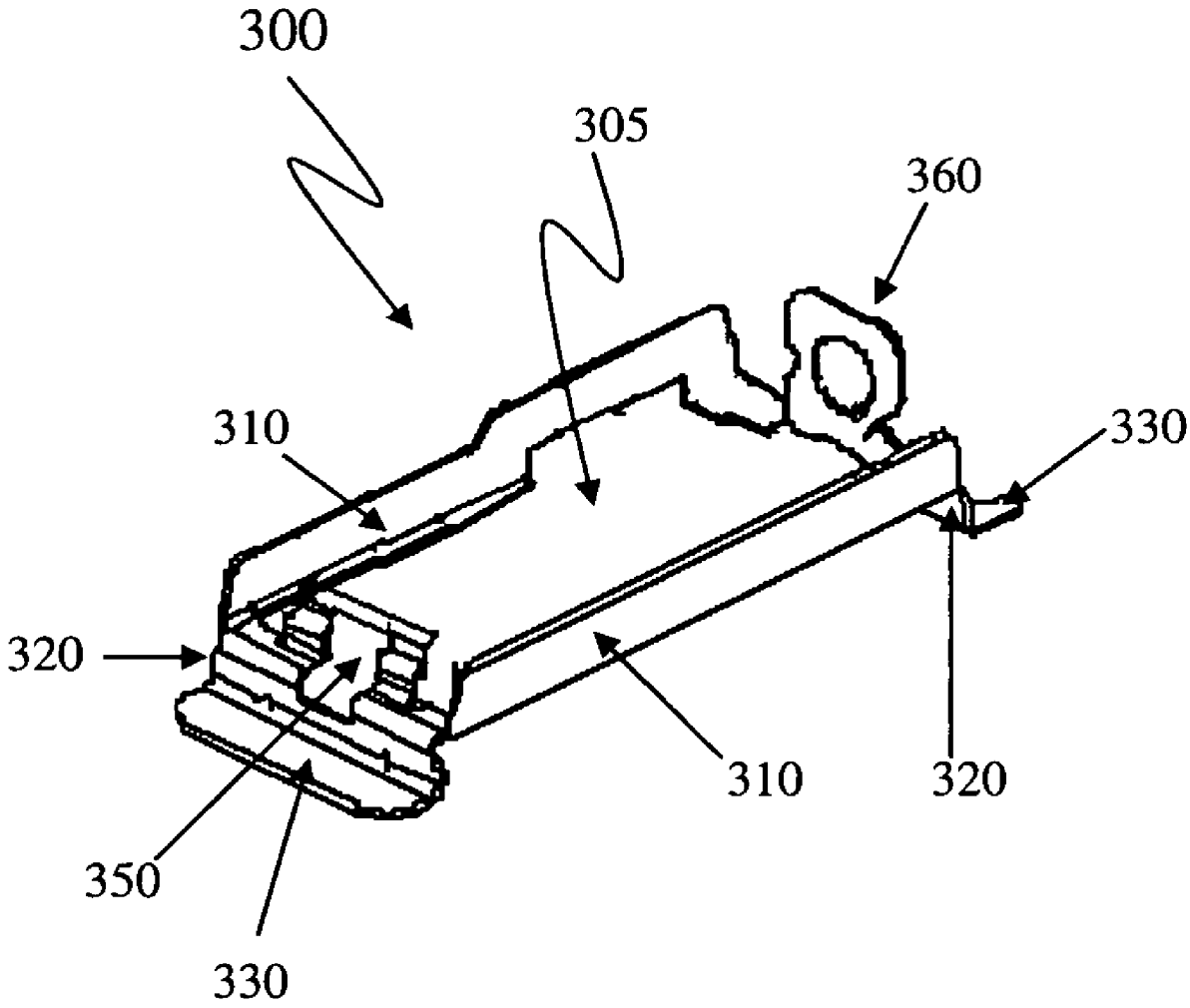
FIG. 3 is a perspective view of an exemplary embodiment of a base component for a securement.

FIG. 3 is a perspective view of an exemplary embodiment of a base component 300 for a securement. Base component 300 can comprise substantially parallel raised edges 310 that can define a length of base component 300. Base component 300 can also comprise substantially parallel depressed edges 320 that can define a width of base component 300. The perimeter defined by parallel raised edges 310 and parallel depressed edges 320 can comprise a passage 305 that can be adapted to accommodate one or more actuators of a switching device such as a circuit breaker (see FIGS. 8 & 9). Parallel depressed edges 320 can comprise a hinge receptor 350 and a lock receptor 360. Hinge receptor 350 can be adapted to interact with a hinge pivot shaft (see FIGS. 1 & 4). Parallel depressed edges 320 can also comprise a lip 330.

Figure 4:
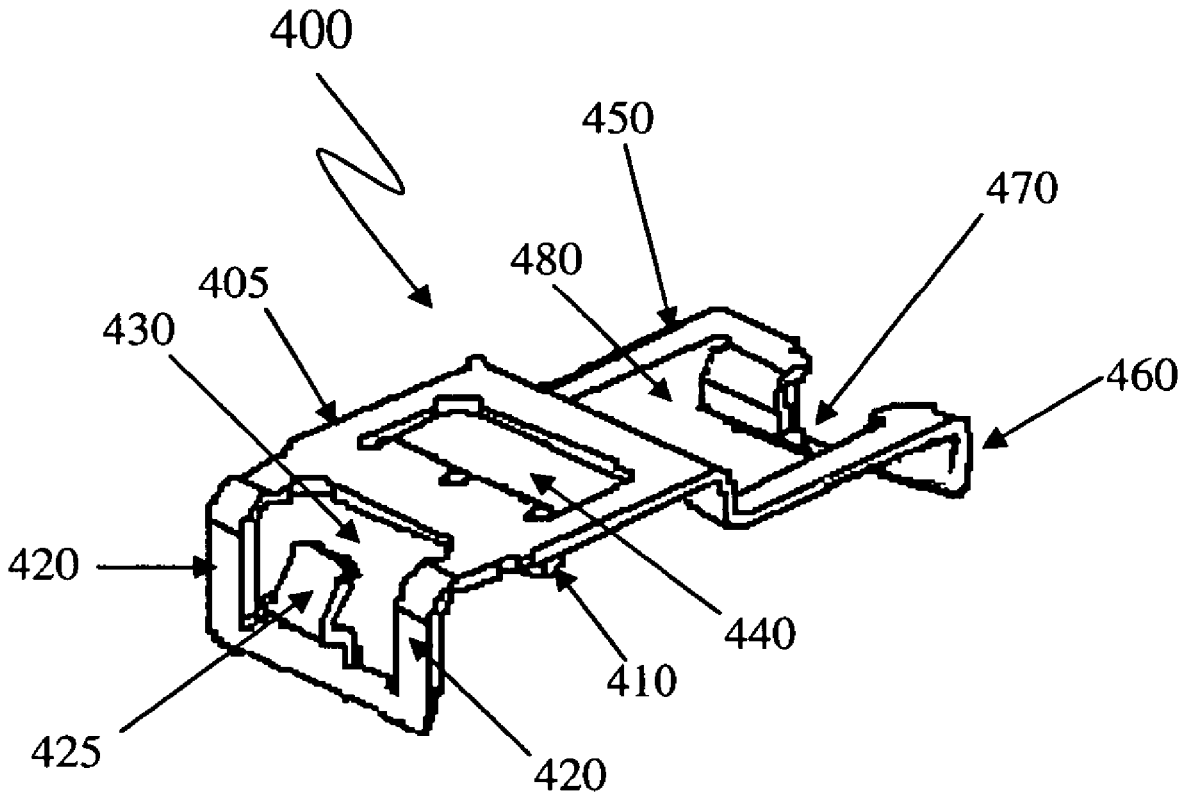
FIG. 4 is a perspective view of an exemplary embodiment of an actuator guard for a securement.

FIG. 4 is a perspective view of an exemplary embodiment of an actuator guard 400 for a securement. Actuator guard 400 can be substantially planar. Certain exemplary embodiments of actuator guard 400 can comprise a first planar portion 405 and a second planar portion 450. First plane 405 can be integral and/or coupled to an actuator restrainer 410. First plane 405 can also comprise first descending edges 420. First descending edges 420 can comprise a hinge pivot shaft 425. Hinge pivot shaft 425 can be adapted to interact with a hinge receptor to form a hinge joint (see FIGS. 1 & 6). Certain exemplary embodiments of second plane 450 can comprise second descending edges 460. Second descending edges 460 can define a slot 470. Slot 470 can be adapted to interact with a lock receptor (see FIGS. 1, 2, & 3).

Certain exemplary embodiments of actuator guard 400 can comprise one or more windows 430, 440, 480. First descending edges 420 can define a first window 430. First planar portion 405 can define a second window 440. Second planar portion 450 can define a third window 480. Incorporation of one or more windows 430, 440, 480 by actuator guard 400 can allow visual access and/or manual access to one or more spaces covered by actuator guard 400.

Figure 5:
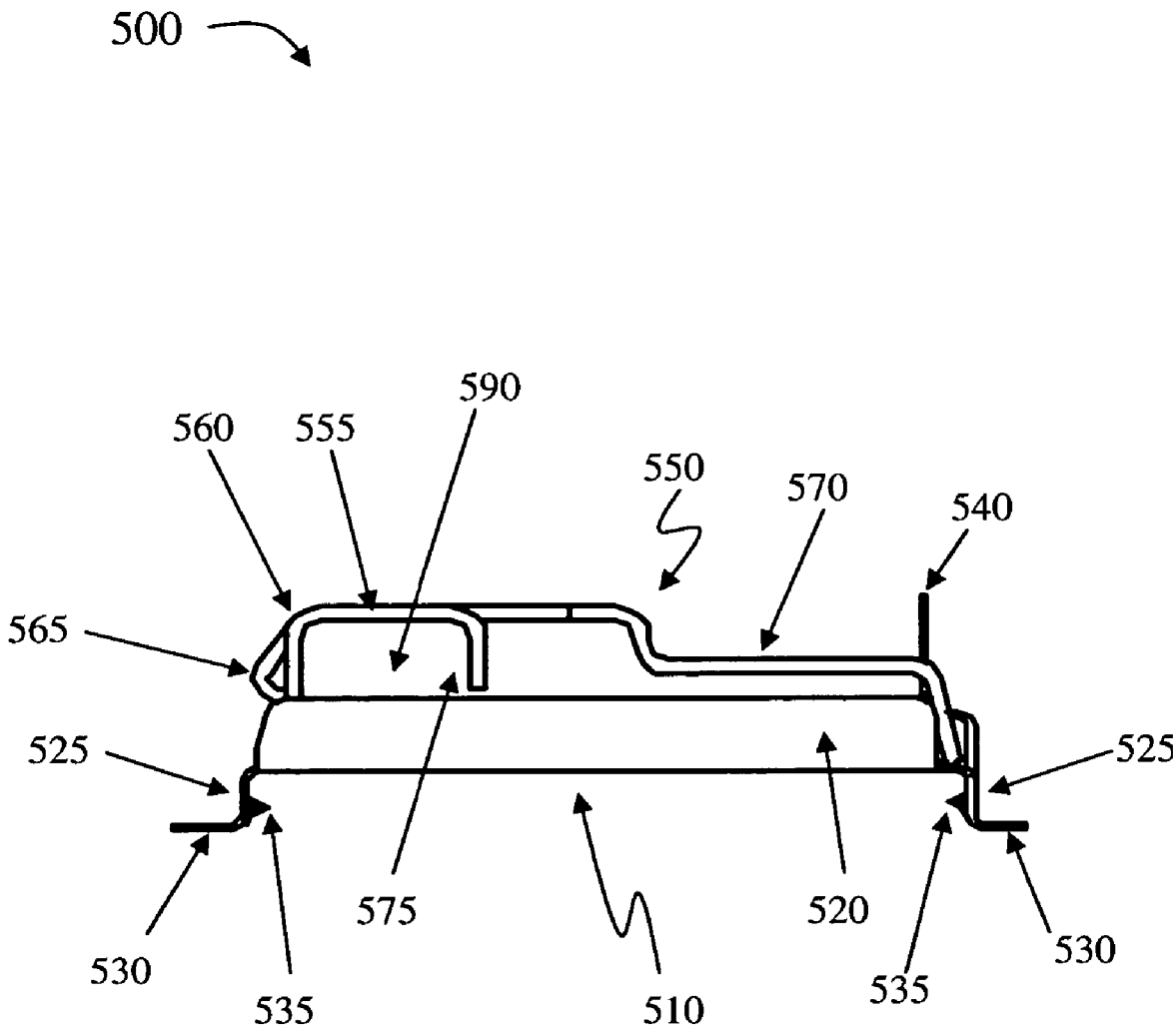
FIG. 5 is a lateral view of an exemplary embodiment of a securement in a closed position.

FIG. 5 is a lateral view of an exemplary embodiment of a securement 500 in a closed position. Securement 500 can comprise a base component 510 and an actuator guard 550. Base component 510 can comprise substantially parallel raised edges 520 that can define a length of base component 510. Base component 510 can also comprise substantially parallel depressed edges 525. Parallel depressed edges 525 can terminate in lips 530. Certain exemplary embodiments of parallel depressed edges 525 can also comprise a plurality of prongs 535. Prongs 535 can improve frictional attachment of base component 520 to a switching device (see FIG. 8). Base component 510 can also comprise a lock receptor 540. Interaction of lock receptor 540 with a locking device can aid in substantially securing securement 500 in a closed position (see FIG. 8).

When securement 500 is in a closed position, certain exemplary embodiments of actuator guard 550 can comprise planar portions 555, 570 that can be oriented substantially parallel to base component 510. A planar portion 555 can be located relatively distal from base component 510. A planar portion 570 can be located relatively proximal to base component 510. Planar portion 555 can comprise first descending edges 560. First descending edges 560 can comprise a hinge pivot shaft 565 that can interact with a hinge receptor (see FIGS. 1, 2, & 3). Certain exemplary embodiments of planar portion 555 can be integral and/or coupled to one or more actuator restrainers 575. The coupling of actuator restrainer 575 to actuator guard 550 can define any angle. Certain exemplary embodiments of actuator restrainer 575 can be oriented substantially perpendicular to planar portion 555.

When securement 500 is in a closed position, the lateral edges of actuator guard 550 can terminate away from parallel raised edges 520 of base component 510. Such an orientation can define a lateral window 590. Certain exemplary embodiments of securement 500 can have variable dimensions for parallel raised edges 520 and/or the lateral edges of actuator guard 550, thus modifying the perimeter of lateral window 590 to suit the functionality of the switching device contained therein. Lateral window 590 can be minimized and/or eliminated by extending parallel raised edges 520 and/or the lateral edges of actuator guard 550.

Figure 6:
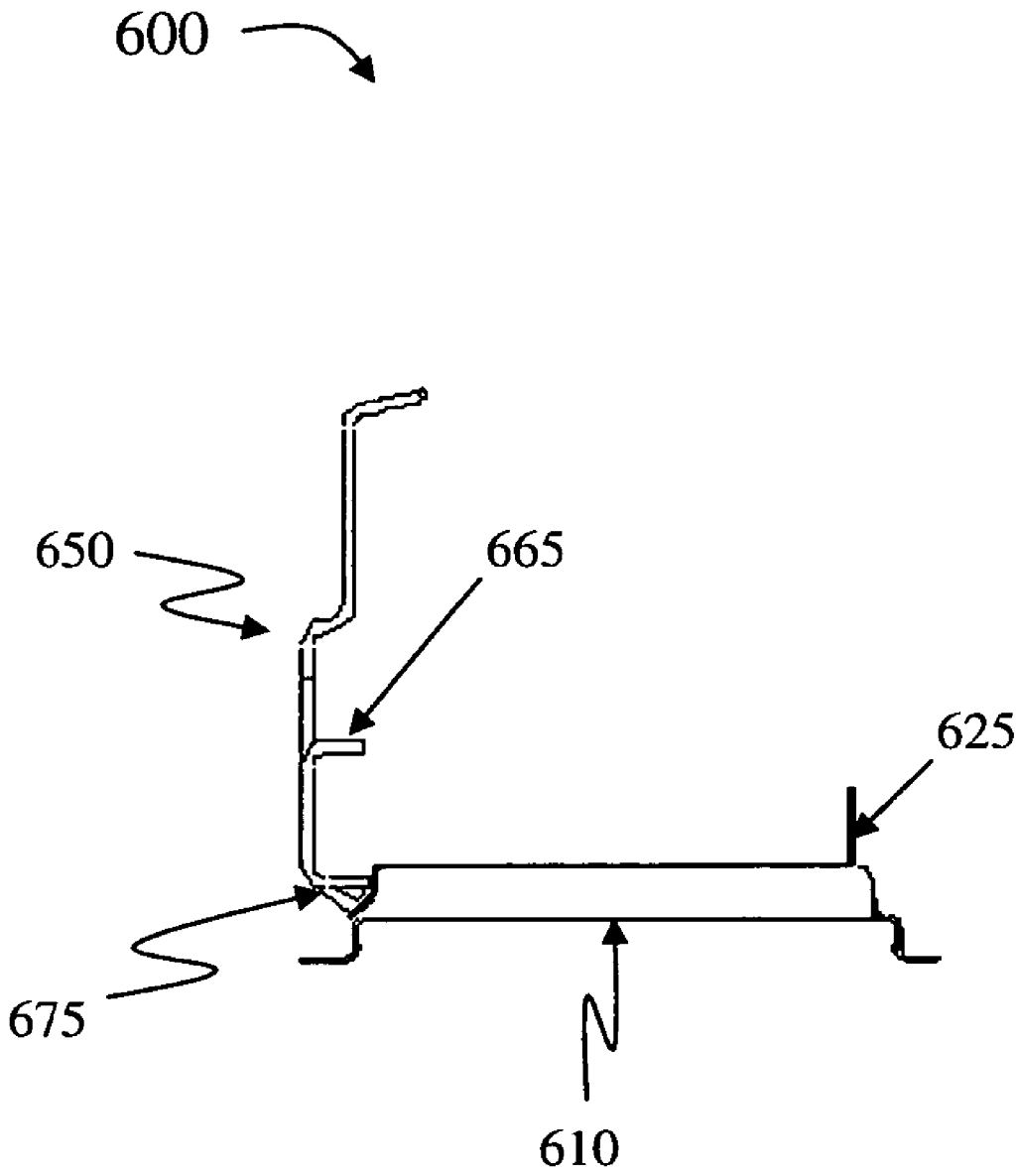
FIG. 6 is a lateral view of an exemplary embodiment of a securement in an open position.

FIG. 6 is a lateral view of an exemplary embodiment of a securement 600 in an open position. Certain exemplary embodiments of securement 600 can comprise an actuator guard 650 integral and/or coupled to an actuator restrainer 665. Certain exemplary embodiments of securement 600 can also comprise a base component 610. Actuator guard 650 and base component 610 can be joined by a hinge joint 675. Hinge joint 675 can be removably or permanently formed. Rotation of actuator guard 650 away from base component 610 can result in an increased distance between actuator restrainer 665 and base component 610 and improve manual access to an actuator of a switching device with which securement 600 is associated. Base component 610 can also comprise a lock receptor 625. Interaction of lock receptor 625 with a locking device can prevent opening of securement 600 and/or substantially interfere with full closure of securement 600 (see FIG. 9).

Figure 7:
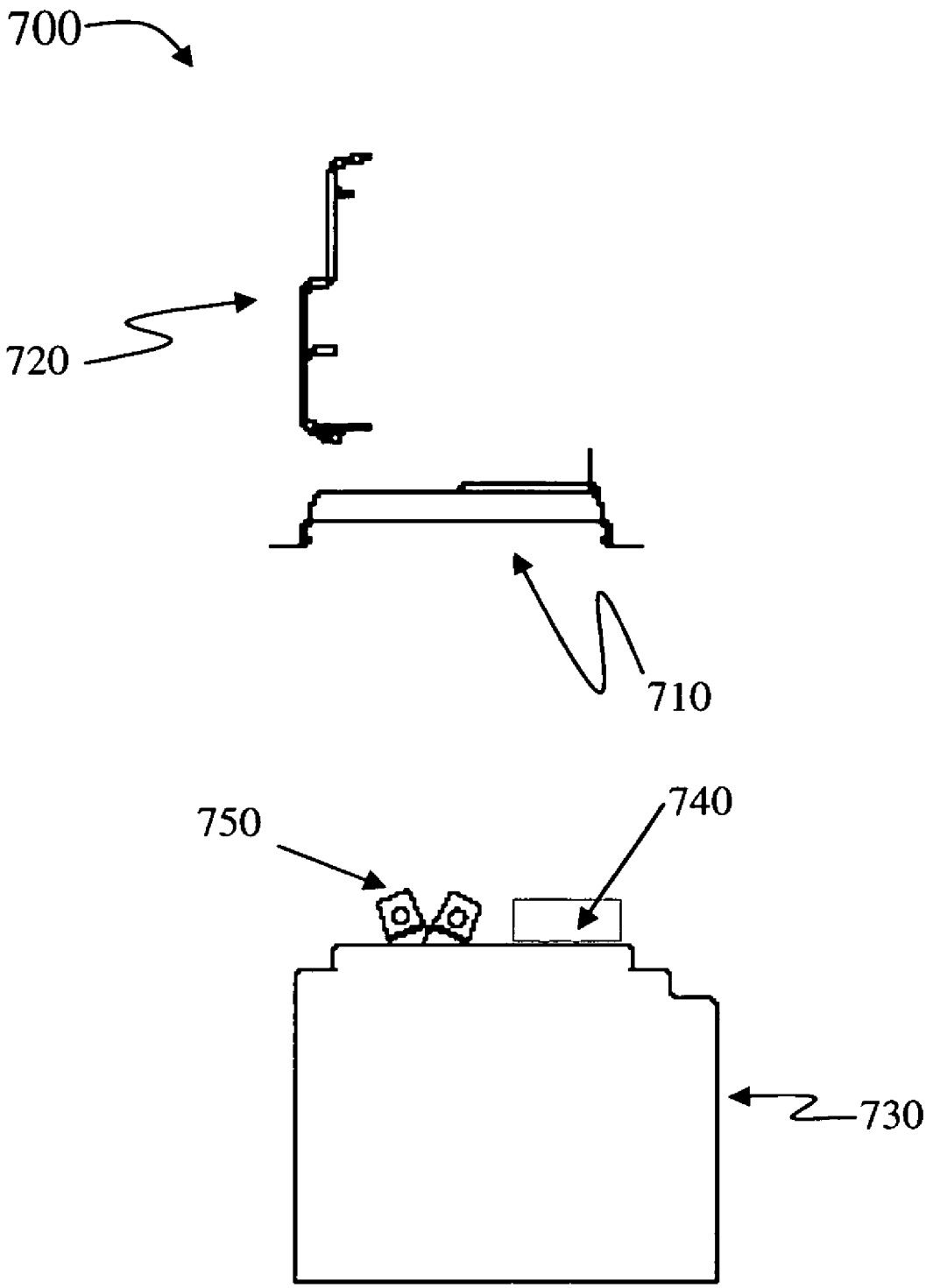
FIG. 7 is a lateral view of an exemplary embodiment of a disassembled securement detached from a circuit breaker.

FIG. 7 is a lateral view of an exemplary embodiment of a disassembled securement 700 detached from a circuit breaker 730. Securement 700 can be formed via coupling of an actuator guard 720 to a base component 710. Base component 710 can be adapted to fit a face 740 of circuit breaker 730. Base component 710 can comprise one or more depressed edges that can be formed to fit the contours of face 740. Circuit breaker 730 and/or face 740 can comprise one or more actuators 750. Actuators 750 can be operable between a first pole and a second pole, each pole corresponding either to an ON position or an OFF position for a switch contained within circuit breaker 730. The range of movement of the actuators from a first to a second pole can define an actuator operation zone. Certain exemplary embodiments of a switch can comprise an automatic tripping mechanism.

Figure 8:
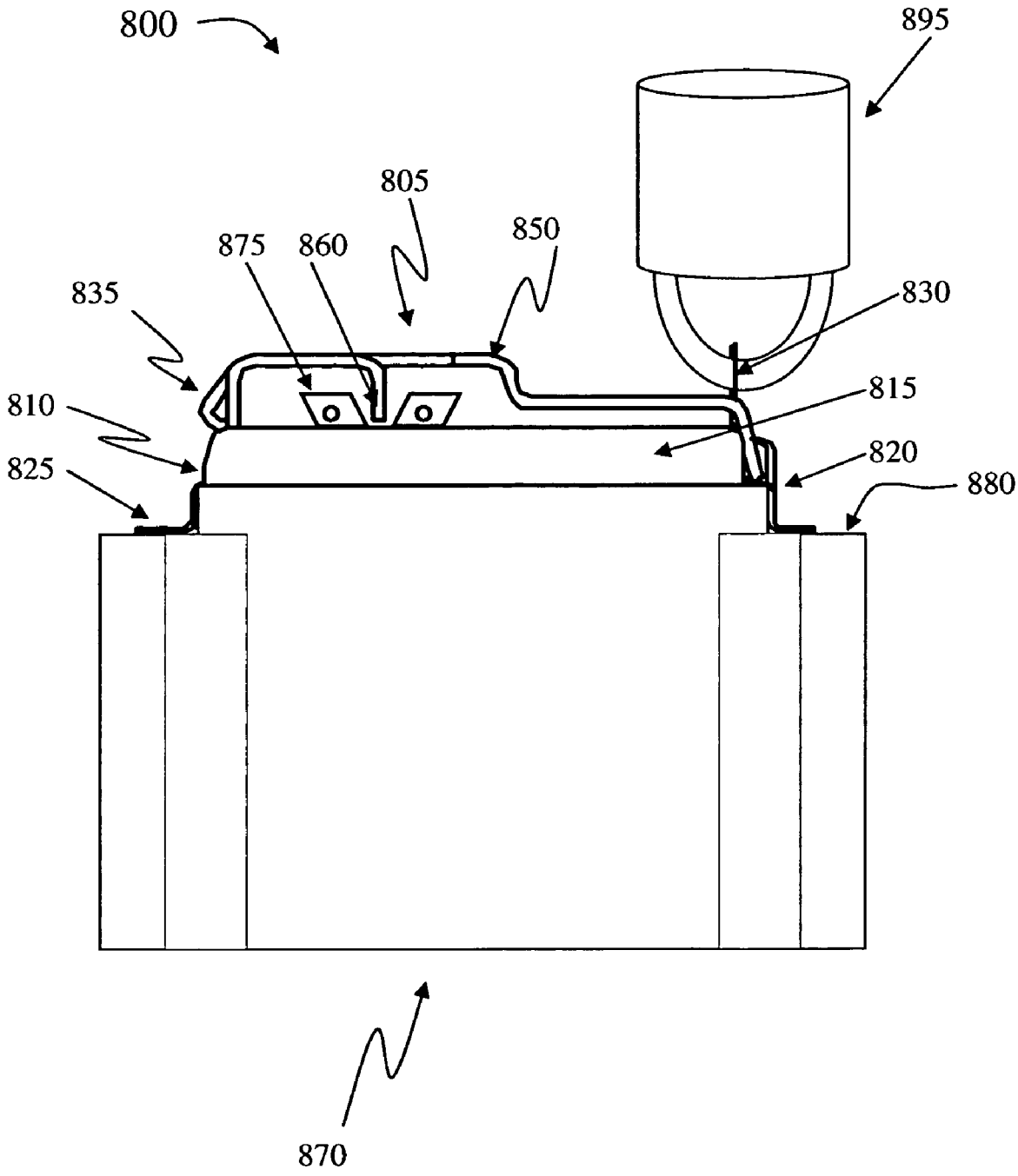
FIG. 8 is a lateral view of an exemplary embodiment of a closed securement attached to a circuit breaker.

FIG. 8 is a lateral view of an exemplary embodiment of an assembly 800 comprising a closed securement 805 coupled to a circuit breaker 870. Circuit breaker 870 can comprise a face 880 wherein one or more actuators 875 are located. Movement of one or more actuators 875 from a first pole to a second pole can define a zone of operation for actuators 875. When a circuit breaker is not associated with securement 805 and/or when securement 805 is in an open position, any actuator 875 can be manually manipulated within the zone of operation for actuators 875.

Certain exemplary embodiments of securement 805 can comprise a base component 810 and an actuator guard 850. In certain exemplary embodiments of securement 805, actuator guard 850 and base component 810 can be rotatably coupled via a hinge joint 835. A length of base component 810 can be defined by substantially parallel raised edges 815. A width of base component 810 can be defined by substantially parallel depressed edges 820 that comprise a lip 825. Depressed edges 820 and/or lip 825 can be formed to adaptively fit the contours of a face 880 of circuit breaker 870. Base component 810 can also comprise a lock receptor 830.

Certain exemplary embodiments of actuator guard 850 can also comprise a means to interact with lock receptor 830, such as a slot defined by second plane 865 (see FIGS. 1-4). In certain exemplary embodiments, actuator guard 850 can be coupled directly to the face 880 of circuit breaker 870. In such an arrangement, face 880 can comprise one or more features of base 810.

When the securement 805 of assembly 800 is in a closed position, actuator restrainer 860 can be positioned substantially within the zone of operation for actuators 875. Prior to closing securement 805, actuators 875 can be positioned in either a first and/or second pole. Differential positioning of actuators 875 can be maintained when securement 805 is closed. That is, when securement 805 is closed, one or more actuators 875 can be prevented from being manually repositioned to a different pole via direct interaction of actuator restrainer 860 with the one or more actuators 875. Moreover, when actuator restrainer 860 is positioned within the operation zone, any automatic tripping function for the switching mechanisms coupled to actuators 875 can be preserved.

In certain exemplary embodiments, securement 805 can prevent manual access to actuators 875 and/or the face 880 of circuit breaker 870. In a closed position and/or operative embodiment, actuator guard 850 can substantially prevent manual access to the face and/or actuators 875 without violating the zone of operation for actuators 875. Parallel raised edges 815 of base component 810 can also substantially prevent manual access to the face and/or actuators 875. After securement 805 is placed in a closed position, lock receptor 830 can interact with a locking device 895 to secure the closed position. Securement 805 can be more permanently attached to the face 880 of circuit breaker 870 via overlaying depressed edges 820 and/or lips 825, such as via an overlaying with an electrical panel cover.

Figure 9:
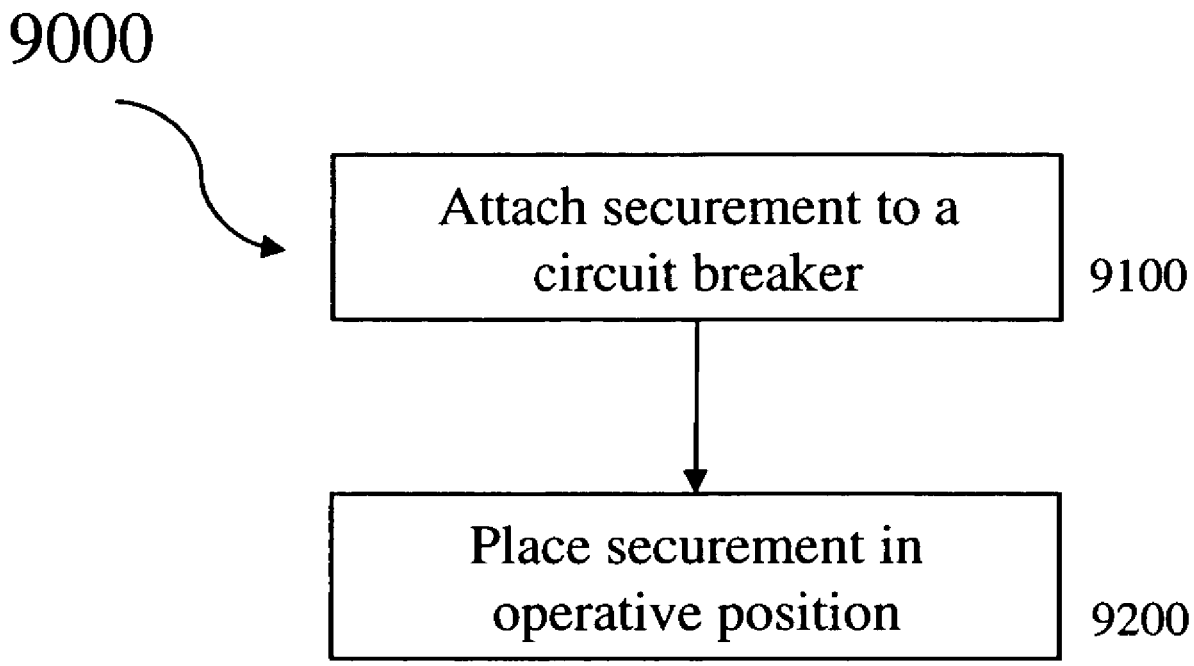
FIG. 9 is a flow chart of an exemplary embodiment of a method 9000.

FIG. 9 is a flow chart of an exemplary embodiment of a method 9000. At activity 9100, a securement, as described herein, can be attached to a switching device, such as a light switch or circuit breaker. A circuit breaker can comprise a face wherein one or more actuators can be located. A securement can comprise an actuator guard. An actuator guard can be directly coupled to the face of the circuit breaker. Certain exemplary embodiments of a securement can also comprise a base component. When attaching a securement to a circuit breaker, the base component can first be placed on the face followed by the coupling of the actuator guard to the base. Alternatively, the actuator guard and the base component can be joined prior to attachment to the circuit breaker. In certain exemplary embodiments, the coupling of the base component to the actuator guard can be achieved via formation of a hinge joint.

Certain exemplary embodiments of actuators for circuit breakers are operable between a first and second pole. A securement, even when in a closed position wherein the actuator guard substantially overlays the base component, can be fitted directly onto the face without adjustment of any actuators. As certain exemplary embodiments of a securement can comprise a separable actuator guard that can be directly coupled to the face of the circuit breaker, certain exemplary embodiments of a face of a circuit breaker can comprise any of the features of a base component.

At activity 9200, a securement can be placed in an operative position. In an operative position, the securement can be closed. When the securement is closed, the actuator guard can be located outside the actuator operation zone. Certain exemplary embodiments of an actuator guard can be substantially planar, and the surfaces defined by the actuator guard can substantially prevent manual access to the actuators. Actuator guards can comprise one or more windows that allow visual access to the actuators and/or manual access to certain regions of the face of the circuit breaker.

In certain exemplary embodiments of a securement, placement of the securement in a closed position can result in a penetration of an actuator's zone of operation by an actuator restrainer. When an actuator restrainer is positioned with the actuator zone of operation, the actuator restrainer can substantially resist any manual movement of an actuator. A closed position can thus result in an operative embodiment wherein the actuator guard is positioned outside the actuator zone of operation, the actuator guard substantially prevents manual manipulation of the actuators, the actuator restrainer is positioned substantially within the actuator zone of operation, and/or the actuator restrainer can resist manual movement of any actuator from a first to a second pole.

The operative position of method 9000 can be secured via interaction of the securement with a locking device. The locking device can interact with a lock receptor. A base component can comprise a lock receptor. Alternately, a lock receptor can be a component of the face of a circuit breaker. When the securement is disengaged from the locking device, the securement can be opened via rotation of the actuator guard away from the base component. Rotation of the actuator guard can result in removal of the actuator restrainer from the actuator zone of operation, which can allow manual manipulation of any actuators between a first and second pole.

FIG. 10 is a flow chart of an exemplary embodiment of a method 10000. At activity 10100, via a first position, a securement can allow manual access to a face and/or actuator of a circuit breaker. An exemplary embodiment of a first position can comprise a sufficient rotation of an actuator guard away from the face of the circuit breaker so that any actuators located on the face can be manually manipulated. Alternatively, a first position can comprise a complete detachment of the actuator guard from the base component and/or face of the circuit breaker.

At activity 10200, via a second position, a securement can substantially prevent manual manipulation of any actuator via a plurality of substantially planar surfaces located outside of the actuator zone of operation. In certain exemplary embodiments, a second position can correspond to a substantially closed orientation for a securement. When in the second position, the securement can substantially resist manual movement of an actuator by placement of an actuator restrainer within the actuator zone of operation. An attempt to manually manipulate an actuator can cause direct contact between the actuator restrainer and the actuator, and such contact can prevent movement of the actuator from a first pole to a second pole without interfering with an automatic tripping function of the circuit breaker.

Still other embodiments will become readily apparent to those skilled in this art from reading the above-recited detailed description and drawings of certain exemplary embodiments. It should be understood that numerous variations, modifications, and additional embodiments are possible, and accordingly, all such variations, modifications, and embodiments are to be regarded as being within the spirit and scope of the appended claims. For example, regardless of the content of any portion (e.g., title, field, background, summary, abstract, drawing figure, etc.) of this application, unless clearly specified to the contrary, there is no requirement for the inclusion in any claim of the application of any particular described or illustrated activity or element, any particular sequence of such activities, or any particular interrelationship of such elements. Moreover, any activity can be repeated, any activity can be performed by multiple entities, and/or any element can be duplicated. Further, any activity or element can be excluded, the sequence of activities can vary, and/or the interrelationship of elements can vary. Accordingly, the descriptions and drawings are to be regarded as illustrative in nature, and not as restrictive. Moreover, when any number or range is described herein, unless clearly stated otherwise, that number or range is approximate. When any range is described herein, unless clearly stated otherwise, that range includes all values therein and all subranges therein. Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render a claim invalid, then any such conflicting information in such incorporated by reference material is specifically not incorporated by reference herein.

What is claimed is:

1. A device adapted to interface with a circuit breaker comprising an actuator operable within an actuator operation zone defined by movement of the actuator between a first pole and a second pole, said device comprising:

an actuator restrainer; and a substantially planar actuator guard coupled to said actuator restrainer; in an operative embodiment, said device operable between:

a first position wherein the actuator is manually moveable between the first pole and the second pole; and a second position wherein:

said substantially planar actuator guard is located outside the actuator operation zone;

said substantially planar actuator guard substantially prevents manual access to the actuator;

said actuator restrainer is positioned substantially within the actuator operation zone; and upon direct contact of the actuator with said actuator retainer, said actuator restrainer substantially resists manual manipulation of the actuator from the first pole to the second pole.

2. The device of claim 1, wherein when in said second position said substantially planar actuator guard is oriented substantially parallel to a substantially planar face of the circuit breaker.

3. The device of claim 1, wherein when in said second position said actuator restrainer is oriented substantially perpendicular to a substantially planar face of the circuit breaker.

4. The device of claim 1, wherein said second position does not interfere with an automatic tripping function of the circuit breaker.

5. The device of claim 1, wherein when in said second position said substantially planar actuator guard provides visual access to the actuator.

6. The device of claim 1, wherein when in said second position said substantially planar actuator guard provides manual access to a region of the circuit breaker outside the actuator operation zone.

7. The device of claim 1, wherein said substantially planar actuator guard is integrally attached to the substantially planar face of the circuit breaker.

8. The device of claim 1, wherein said actuator guard is adapted to interface with the circuit breaker via a base component adapted to fit the substantially planar face.

9. The device of claim 1, wherein said actuator restrainer is removably coupled to said substantially planar actuator guard.

10. The device of claim 1, wherein said actuator restrainer is integral with said substantially planar actuator guard.

11. The device of claim 1, wherein said substantially planar actuator guard is adapted to interact with a lock receptor.

12. The device of claim 1, wherein said second position is securable with a locking device.

13. The device of claim 1, wherein the first pole corresponds to either ON or OFF.

14. The device of claim 1, wherein the actuator is bridged to one or more additional actuators.

15. The device of claim 1, wherein when the circuit breaker comprises at least one actuator positioned at the first pole and at least one actuator positioned at the second pole, in said second position said device substantially prevents manual movement of any actuator to an opposite pole.

16. A device adapted to interface with an actuator operable within an actuator operation zone defined by movement of the actuator between a first pole and a second pole, said device comprising:

an actuator guard; and coupled to said actuator guard, a means for restraining the actuator;

in an operative embodiment, said device operable between:

a first position wherein the actuator is manually moveable between the first pole and the second pole; and a second position wherein:

said actuator guard substantially prevents manual access to the actuator without said actuator guard penetrating the actuator operation zone;

said means for restraining the actuator is positioned substantially within the actuator operation zone; and upon direct contact of the actuator with said means for restraining the actuator, said means for restraining the actuator substantially prevents movement of the actuator from the first pole to the second pole while preserving an automatic tripping function of the circuit breaker.

17. The device of claim 16, wherein said actuator guard further comprises a means for interacting with a locking device, said locking device enabling the securement of said second position.

18. The device of claim 16, wherein said actuator guard further comprises a means to substantially prevent detachment of the actuator guard from the circuit breaker.

19. A system, comprising:

a circuit breaker comprising a substantially planar face, the face comprising an actuator, the actuator operable within an actuator operation zone defined by movement of the actuator between a first pole and a second pole; and a securement comprising:

a base component adapted to fit on the substantially planar face; said base component comprising a lock receptor adapted to interact with a locking device;

an actuator guard adapted to interface with the substantially planar face of the circuit breaker via association with said base component; and an actuator restrainer, said actuator restrainer integral with said actuator guard;

said actuator guard operable between:

a first position wherein the actuator is manually moveable; and a second position wherein:

manual access to the substantially planar face is substantially prevented by said actuator guard;

said actuator guard is located outside the actuator operation zone;

said actuator restrainer is positioned substantially within the actuator operation zone; and said lock receptor is positioned to interact with the locking device to secure said second position;

said actuator restrainer resists manual manipulation of the one or more actuators from the first pole to the second pole without interfering with an automatic tripping function of the circuit breaker.

20. The system of claim 19, wherein said base component comprises a hinge receptor and said actuator guard comprises a hinge pivot shaft, said hinge pivot shaft is insertable though said hinge receptor to form a hinge, said hinge providing a hinged attachment for said base component and said actuator guard.

21. The system of claim 19, wherein said actuator guard comprises a hinge receptor and said base component comprises a hinge pivot shaft, said hinge pivot shaft is insertable though said hinge receptor to form a hinge, said hinge providing a hinged attachment for said base component and said actuator guard.

22. The system of claim 19, wherein said actuator guard defines a slot for insertion of said lock receptor.

23. The system of claim 19, wherein said base component comprises a plurality of prongs that provide frictional attachment of said base component to the substantially planar face of the circuit breaker.

24. The system of claim 19, wherein when in said closed position said actuator guard comprises one or more windows for visually accessing the substantially planar face of the circuit breaker.

* * * * *